US007158021B2

(12) United States Patent
Hammett

(10) Patent No.: US 7,158,021 B2
(45) Date of Patent: Jan. 2, 2007

(54) STIGMERGIC SENSOR SECURITY SYSTEM

(75) Inventor: Geoffrey G. Hammett, Norcross, GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 116 days.

(21) Appl. No.: 10/829,563

(22) Filed: Apr. 22, 2004

(65) Prior Publication Data

US 2005/0237176 A1 Oct. 27, 2005

(51) Int. Cl.
*G08B 23/00* (2006.01)

(52) U.S. Cl. ..... 340/500; 340/628; 340/541; 340/522

(58) Field of Classification Search ..... 340/500, 340/628, 541, 522, 508, 523, 526, 552, 565
See application file for complete search history.

(56) References Cited

U.S. PATENT DOCUMENTS 4,574,305 A 3/1986 Campbell et al. ..... 358/86
5,475,365 A * 12/1995 Hoseit et al. ..... 340/522
5,701,161 A * 12/1997 Williams et al. ..... 348/468
5,907,288 A * 5/1999 Clark et al. ..... 340/5.54
5,963,944 A 10/1999 Adams ..... 707/10
6,078,269 A * 6/2000 Markwell et al. ..... 340/825.5
6,157,299 A * 12/2000 Wang ..... 340/506
6,690,411 B1 2/2004 Naidoo et al. ..... 348/143
6,822,568 B1 * 11/2004 Gehlot et al. ..... 340/572.1

FOREIGN PATENT DOCUMENTS

EP 0 729 125 8/1996
EP 0 762 358 3/1997

* cited by examiner

*Primary Examiner*—Anh V. La

(57) ABSTRACT

A system and method for providing security utilizing stigmergic behavior. A plurality of sensors is adapted to communicate with one another. Each sensor may be elevated from a stable state corresponding with a secure environment into an elevated state corresponding with a first detection event. Each sensor after detecting a first detection event communicates with another sensor in order to elevate the other sensor into the elevated state. An alarm signal is generated in response to one or more second detection events subsequently occurring within the security system.

30 Claims, 4 Drawing Sheets

STIGMERGIC SENSOR SECURITY SYSTEM

TECHNICAL FIELD

The present invention relates to enhancing the reliability of security systems, and more particularly to alarm sensors collaborating with one another to optimize the sensitivity of the security system.

BACKGROUND OF THE INVENTION

There are numerous types of security systems available to the consumer. Some of these known security systems may be based upon a cable network such as an HFC network. These known home security systems use individual isolated sensors that are prone to triggering false alarms. These known sensors are isolated in that these sensors operate independently from any other sensors in order to activate an alarm. Moreover, these known sensors are monitored by a central controller that manages the sensors and sends out an alarm when any one of the sensors is activated. Any one of these known individual sensors can fail or false trigger that may result in the central controller failing to generate an alarm or may falsely activate and result in the central controller generating a false alarm.

Social insects are well known for their complex group behaviors emerging from the cooperative behaviors of the many small insects within a large community. This cooperative behavior of insects for the benefit of the community is commonly referred to as stigmergic behavior. The stigmergic behavior of a community of insects is distinguishable from the autonomous behavior of the sensors of known security systems. What is needed is a security system that implements stigmergic behavior to qualify alarm conditions. In other words, what is needed is a security system that permits sensors to interact with one another in order to qualify and appropriately generate an alarm signal.

BRIEF DISCRIPTION OF THE DRAWINGS

DETAILED DESCRIPTION

The present invention will be described more fully hereinafter with reference to the accompanying drawings in which like numerals represent like elements throughout the several figures, and in which exemplary embodiments of the invention are shown. This invention may, however, be embodied in many different forms and should not be construed as being limited to the embodiments set forth herein; rather, the embodiments are provided so that this disclosure will be thorough and complete, and will fully convey the scope of the invention to those skilled in the art. The present invention is described more fully hereinbelow.

The present invention may be implemented in the context of a subscriber television system (STS) 100 as hardware, software, firmware, or a combination thereof. An STS 100 may be configured in many different ways, but generally may be a two-way cable system that includes a network 102 interposed between a headend 104 and a plurality of subscriber premises $\mathbf{110}_{1\text{-}N}$. A digital subscriber communication terminal (DSCT) 120 located at a subscriber's premises provides an interface between the headend 104 and the subscriber premises $\mathbf{110}_{1\text{-}N}$. The headend 104 receives and processes programming signals from content providers. The STS 100 may include additional components or include systems that forgo utilizing physical structured cabling for transmission such as satellite systems.

Figure 1:
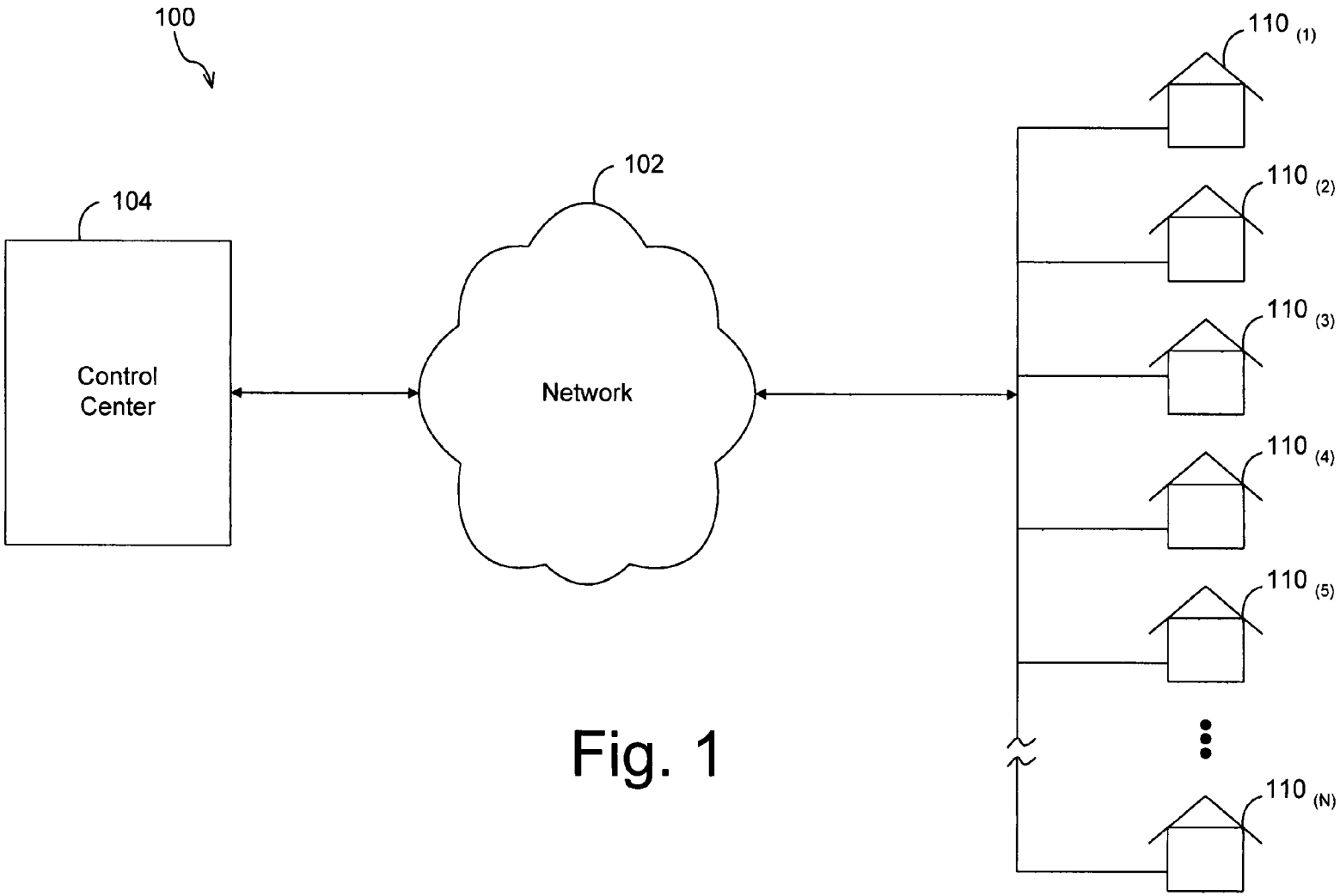
FIG. 1 illustrates one embodiment of a broadband communications system in which the present invention may be deployed.
Figure 2:
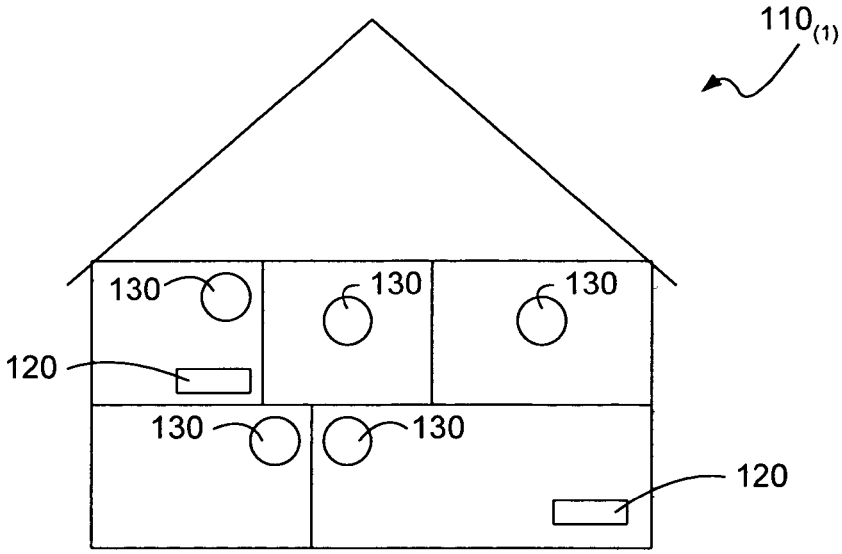
FIG. 2 illustrates one premises have a plurality of sensors connected to the communications system of FIG. 1.
Figure 3:
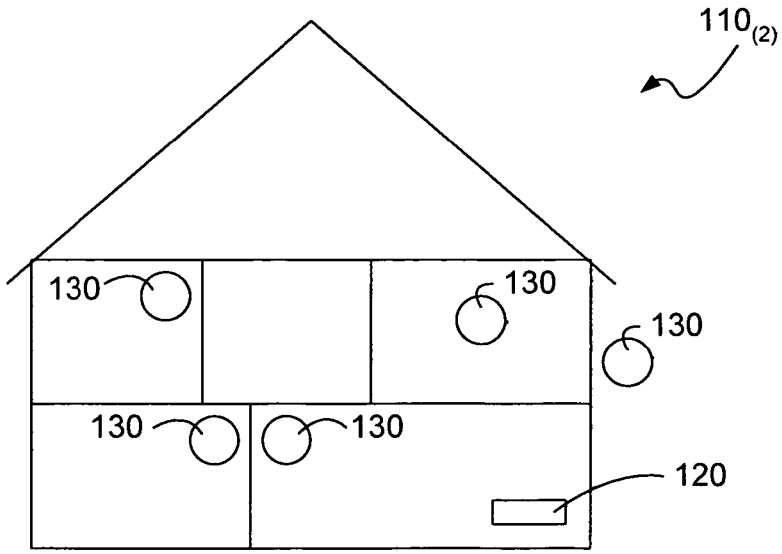
FIG. 3 illustrates another premises having a plurality of sensors connected to the communications system of FIG. 1.

Each of the subscriber premises $\mathbf{110}_{1\text{-}N}$ may also include inside or in close proximity one or more sensors 130. FIG. 2 illustrates subscriber premises $\mathbf{110}_1$ having a pair of DSCTs 120 and a plurality of sensors 130. FIG. 3 illustrates subscriber premises $\mathbf{110}_2$ having a single DSCT 120 and a plurality of sensors 130. However, any of the subscriber premises $\mathbf{110}_{1\text{-}N}$ may be configured differently and include any number of DHCTs 120 and any number of sensors 130.

The sensors 130 associated with a premises are networked together utilizing standard technologies such as Ethernet, cable based, phone-line based, power-line based, and wireless, so that the sensors recognize and communicate with each other. Preferably, the network of sensors 130 is a peer-to-peer or point-to-point network. However, a controller or server based network may also be utilized. The network of the sensors 130 preferably share a connection, by whatever means, to the network 102. For example, in FIG. 2, the sensors 130 utilize either, or both, of the DHCTs 120 to connect to the network 102.

One way the sensors 130 may communicate with one another and the network 102 is by utilizing Ethernet cards connected with a hub and coax or Cat 5 cabling. Alternatively, existing electrical outlets or phone jacks may be used to network the sensors 130. Preferably, however, the sensors are networked by sending radio-frequency signals between the sensors. For example, wireless networks such as Bluetooth, IrDA, IEEE 802.11, HomeRF, Wi-Fi and others may be utilized.

Each of the sensors 130 is able to make decisions about its state on its own and communicate its current state status to any other sensor. Together the sensors 130 collaborate about the state of the environment surrounding the network of sensors 130 for the security system. Therefore, the sensors 130 may be referred to as intelligent sensors. A sensor 130 may be an open and closed contact sensor, fire or smoke detector, heat detector, photoelectric sensor, pressure sensor, motion sensor, seismic sensor, proximity sensor, metal sensor, or any other sensor capable of detecting a stimulus. Detection of stimuli may be referred to as a detection event.

The sensors 130 are adapted to provide variable responses that depend on the type of stimuli intended to be received by the sensor. For example, one of the sensors 130 may be a photoelectric sensor having an output that varies in response to the intensity of incident radiation. Another example would be an open and closed contact sensor configured to detect openings or closings within one or more particular distance thresholds. In yet another example, a proximity sensor could have a response that varies depending on the proximity of an object to the sensor. An object which is approaching the sensor could result in one response and an object departing from the sensor could result in another response. Alternatively, variable responses could be provided by a proximity sensor based upon different ranges of distances of the object from the sensor regardless of whether the object is approaching or departing. Other sensors 130 may provide a variable response based upon sensitivities of stimuli such as, but not limited to, light, time, temperature, sound, pressure, and EMR.

Figure 4:
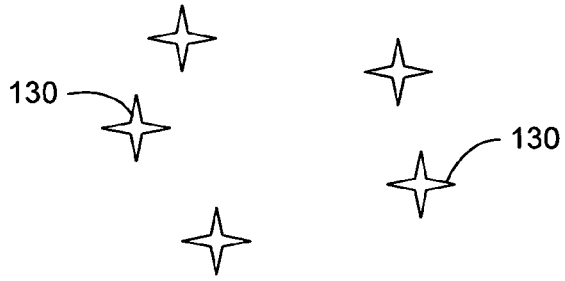
FIG. 4 illustrates sensors of the present invention in a stable state corresponding with a secure environment.
Figure 5:
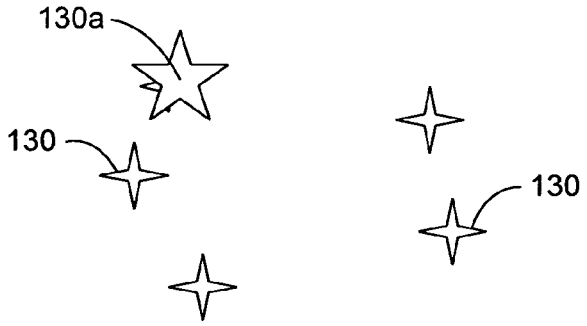
FIG. 5 illustrates one of the sensors of FIG. 4 in an elevated state corresponding with a first detection event.

FIGS. 4–8 illustrate the progression of states of the sensors 130. Each of the sensors 130 should be adapted to be elevated from a stable state corresponding with a secure environment to an elevated state corresponding with a detection event. FIG. 4 illustrates a plurality of sensors 130, depicted by four-point stars, all of which are in the stable state. FIG. 5 then illustrates the sensors 130 of FIG. 4 where one of the sensors, a sensor 130*a*, is depicted by an enlarged five-point star overtop its corresponding four-point star to depict a sensor in the elevated state in response to detecting a detection event.

Figure 6:
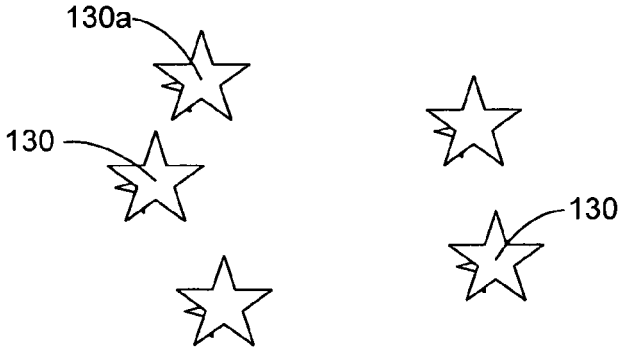
FIG. 6 illustrates the sensors of FIG. 4 in elevated states in response to one of the sensors detecting a first detection event as shown in FIG. 5.
Figure 7:
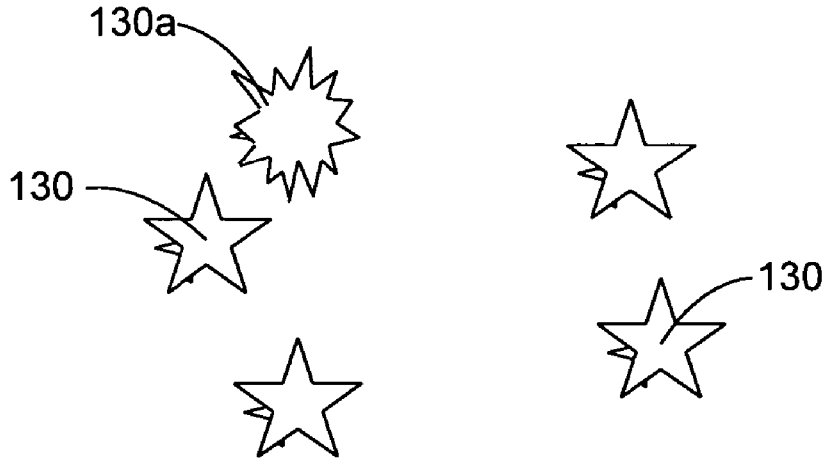
FIG. 7 illustrates one of the sensors of FIG. 4 in a further elevated state corresponding with a second detection event.
Figure 8:
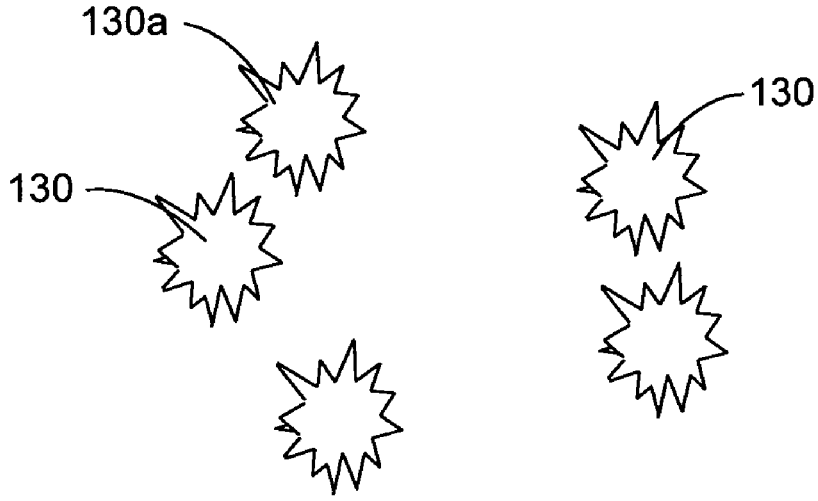
FIG. 8 illustrates each of the sensors of FIG. 4 further elevated in response to one of the sensors detecting a second detection event as shown in FIG. 7 where an alarm signal may be generated.

Once a first detection event is detected by one of the sensors 130, the sensor 130 which detected the first detection event communicates to one or more of the other sensors 130 in the network of sensors in order to elevate the sensors into the elevated state. FIG. 6 illustrates the plurality of sensors 130 elevated into the elevated state as a result of the sensor 130*a* in FIG. 5 detecting the first detection event. The sensors 130 in an elevated state are depicted by five-point stars overlapping their corresponding four-point stars. In the event of any one or more of the sensors 130 detects a second detection event, the sensor 130 detecting the second detection event communicates to the other sensors 130. FIG. 7 illustrates the sensor 130*a* in a further elevated state corresponding with a second detection event. Sensors 130 in the further elevated state are depicted by twelve-point stars overlapping corresponding representations of sensors in any lower state. In this case, the sensor 130*a* detected the first detection event, alerted the other sensors 130 of the occurrence of the first detection event, and also detected the second detection event. However, the sensor 130 that detects the second detection event may be other than the sensor 130 which had detected the first detection event. FIG. 8 illustrates each of the sensors of FIG. 4 further elevated, as depicted by the twelve-point stars, in response to one of the sensors detecting a second detection event as shown in FIG. 7 where an alarm signal may then be generated.

An alarm signal may be generated as a result of any one or more sensors 130 being in an elevated state and one or more second detection events occurring within the security system. In one embodiment, the security system of the present invention may require more than one occurrence of a second detection event. One sensor 130 may detect separate occurrences of a second detection event. Preferably, however, different sensors 130 detect separate occurrences of a second detection event. In another embodiment, separate sensors 130 may detect the same second detection event where an alarm signal may then be generated. In some embodiments, it may be desirable to place a limit on the amount of time any elevated state could continue to exist. The elevated state of one or more sensors could expire if a second detection event is not detected with a period of time.

One of the sensors 130 itself may generate the alarm signal if it detects the second detection event or instead if another sensor detects the second detection event. Alternatively, a central controller such as a DHCT 130 which may be utilized to network the sensors 130 may generate the alarm signal. The central controller may generate the alarm signal as a result of one of the sensors 130 in the elevated state and the same sensor 130, or any other sensor 130, detecting the second detection event. The alarm signal generated at one premises may be transmitted over the network 102 to another premises or to the control center 104 and then to another premises. In another embodiment, the control center 104 itself could generate the alarm signal and transmit the alarm signal back across the network 102 to any of the other subscriber premises. In one embodiment, the control center 104 could be located at the headend of a subscriber television system adapted to monitor, interpret and process alarm signals in order to initiate an appropriate response. The headend could include what is commonly referred to as an emergency alert receiver (EAR) that could generate an alarm signal or issue warnings such as those necessary to elevate the state of sensors at a subscriber premises or on a regional basis. For example, subscriber premises that are remote from one another could receive an alarm signal from the headend.

The sensor 130 which detects the first detection event and the sensor 130 which subsequently, or concurrently, detects the second detection event may be at the same premises. For example, in FIG. 2, a sensor 130 in the lower level of the subscriber premises $\mathbf{110}_1$ may detect the first detection event and a sensor 130 on the upper level of the subscriber premises $\mathbf{110}_1$ may detect the second detection event. Alternatively, a sensor 130 of the subscriber premises $\mathbf{110}_1$ in FIG. 2 may detect the first detection event and a sensor 130 of a second subscriber premises, such as the subscriber premises $\mathbf{110}_2$ in FIG. 3, may detect the second detection event. In such case, the sensor 130 at the subscriber premises $\mathbf{110}_1$ communicates over the network 102 to elevate the sensors 130 at other subscriber premises such as subscriber premises $\mathbf{110}_2$. In another embodiment, one sensor 130 at one premises may detect a second detection event and another sensor 130 at another premises may detect the same second detection event.

The use of the security system as described above constitutes an inventive method of the present invention in addition to the security system itself. In practicing the method of providing security with the sensors 130 as described above, the steps include providing a plurality of sensors 130 adapted to communicate with one another as described above. The method then includes the step of elevating one of the sensors 130 from a stable state corresponding with a secure environment into an elevated state corresponding with a first detection event. The method also includes communicating to at least one other sensor 130 to elevate the at least one other sensor 130 into the elevated state. Next, the method includes generating an alarm signal in response to one or more second detection events occurring within the security system such as at one of the sensors in the elevated state.

In one embodiment, the alarm signal generating step may include one of the sensors generating the alarm signal in response to detecting the second detection event. Or, the alarm signal generating step may include one of the sensors generating the alarm signal in response to another different sensor detecting the second detection event. In another embodiment, the method may include providing a central controller for generating the alarm signal as a result of at least one of the sensors being in the elevated state and at least one of the sensors detecting the second detection event.

Alternatively, the central controller could generate the alarm signal as a result of the same sensor detecting both of the first and second detection events.

In other embodiments, the method may include the step of the first detection event occurring at one premises and the second detection event occurring at another different premises. Or, the alarm signal generating step could include one of the sensors detecting a second detection event and one of the sensors detecting another different second detection event.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

What is claimed is:

1. A security system comprising first and second sensors, each said sensor adapted to be elevated from a stable state corresponding with a secure environment into an elevated state corresponding with a first detection event, each said sensor configured to communicate with the other said sensor in order to elevate the other said sensor into said elevated state, and a first central controller adapted to generate an alarm signal in response to one or more second detection events occurring at one of said sensors in said elevated within said security system.

2. The security system of claim 1 wherein one of said sensors generates said alarm signal in response to detecting said second detection event.

3. The security system of claim 1 wherein one of said sensors generates said alarm signal in response to the other of said sensors detecting said second detection event.

4. The security system of claim 1 wherein either of said sensors generates said alarm signal corresponding with said second detection event occurring at either of said sensors.

5. The security system of claim 1 wherein said alarm signal is generated as a result of both said sensors being in said elevated state and one of said sensors in said elevated state detecting said second detection event.

6. The security system of claim 1 wherein each said sensor is configured to communicate current state status to the other said sensor.

7. The security system of claim 1 wherein said central controller generates said alarm signal as a result of the same said sensor detecting said first and second detection events.

8. The security system of claim 1 wherein said central controller generates said alarm signal as a result of different said sensors detecting said first and second detection events.

9. The security system of claim 1 wherein said first and second sensors are at one premises.

10. The security system of claim 1 wherein said first sensor is at one premises and said second sensor is at a second premises.

11. The security system of claim 1 wherein said first detection event occurs at one premises and said second detection event occurs at another premises.

12. The security system of claim 1, wherein said alarm signal generated by the first central controller in response to a second detection event at one premises is transmitted across a network to a second central controller at another premises.

13. The security system of claim 12, wherein the first central controller transmits the alarm signal to a control center via a two-way cable system, and wherein the control center transmits the alarm signal via the two-way cable system to the second central controller.

14. The security system of claim 12, wherein the first central controller transmits the alarm signal to a control center via a two-way cable system, and wherein the control center transmits the alarm signal via the two-way cable system to a plurality of coupled central controllers, wherein each coupled central controller is located at discrete premises.

15. The security system of claim 14 wherein each of the central controllers is a DHCT, and wherein the control center is located in a headend.

16. The security system of claim 14 wherein both said second detection events are detected by the same said sensor.

17. The security system of claim 1 wherein both said sensors detect the same said second detection event.

18. A method for providing security comprising the steps of:

providing a plurality of sensors adapted to communicate with one another, elevating one of said sensors from a stable state corresponding with a secure environment into an elevated state corresponding with a first detection event;

communicating to at least one other said sensor to elevate the at least one other said sensor into said elevated state, wherein one of said sensors communicates its current state to the plurality of sensors; and generating an alarm signal in response to one or more second detection events occurring at one of said sensors in said elevated state.

19. The method of claim 18 wherein said alarm signal generating step comprises one of said sensors generating said alarm signal in response to detecting said second detection event.

20. The method of claim 18 wherein said alarm signal generating step comprises one of said sensors generating said alarm signal in response to another of said sensors detecting said second detection event.

21. The method of claim 18 wherein said alarm signal generating step comprises either of said sensors generating said alarm signal corresponding with said second detection event occurring at either of said sensors.

22. The method of claim 18 further comprising the steps of providing a central controller and said central controller generating said alarm signal as a result of at least one of said sensors being in said elevated state and at least one of said sensors detecting said second detection event.

23. The method of claim 22 wherein said central controller is a DHCT.

24. The method of claim 22 wherein said alarm signal generating step comprises said central controller generating said alarm signal as a result of different said sensors detecting said first and second detection events.

25. The method of claim 18 wherein said first detection event occurs at one premises and said second detection event occurs at another premises.

26. The method of claim 25 further comprising the step of transmitting across a two-way network said alarm signal to a control center generated in response to said second detection event occurring at another premises.

27. The method of claim 18 wherein said alarm signal generating step comprises one of said sensors detecting said second detection event and one of said sensors detecting another said second detection event.

28. The method of claim 27 wherein said alarm signal generating step comprises one of said second detection events detected by one of said sensors and the other of said second detection events detected by another said sensor.

29. The method of claim 27 wherein said alarm signal generating step comprises said second detection events detected by the same said sensor.

30. The method of claim 18 wherein said alarm signal generating step comprises different said sensors detecting the same said second detection event.

* * * * *